US007695257B2

(12) United States Patent
Joo et al.

(10) Patent No.: US 7,695,257 B2
(45) Date of Patent: Apr. 13, 2010

(54) APPARATUS FOR PREVENTING VACUUM OF SCROLL COMPRESSOR

(75) Inventors: Young-Se Joo, Gyeongsangnam-Do (KR); Tae-Hee Nam, Gyeongsangnam-Do (KR); Hong-Gyun Jin, Gyeongsangnam-Do (KR); Yun-Su Ju, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 294 days.

(21) Appl. No.: 11/667,692

(22) PCT Filed: Mar. 31, 2006

(86) PCT No.: PCT/KR2006/001209

§ 371 (c)(1),
(2), (4) Date: May 14, 2007

(87) PCT Pub. No.: WO2007/114531

PCT Pub. Date: Oct. 11, 2007

(65) Prior Publication Data

US 2009/0074593 A1 Mar. 19, 2009

(51) Int. Cl.
*F03C 2/00* (2006.01)
*F04C 18/00* (2006.01)

(52) U.S. Cl. ..... 418/55.5; 418/55.1; 418/57; 417/308; 417/310

(58) Field of Classification Search ..... 418/55.1–55.6, 418/57, 270; 417/310, 410.5, 308
See application file for complete search history.

(56) References Cited

U.S. PATENT DOCUMENTS 5,169,294 A 12/1992 Barito
6,672,845 B1 * 1/2004 Kim et al. ..... 417/310
6,769,881 B2 * 8/2004 Lee ..... 417/310
6,893,229 B2 * 5/2005 Choi et al. ..... 417/310
2003/0206813 A1 * 11/2003 Koo ..... 417/310

FOREIGN PATENT DOCUMENTS

CN 1896518 1/2007
EP 0681105 11/1992
WO WO 99/45274 9/1999

OTHER PUBLICATIONS

PCT Search Report dated Dec. 6, 2006.
Chinese Office Action dated Apr. 24, 2009.

* cited by examiner

*Primary Examiner*—Theresa Trieu
(74) *Attorney, Agent, or Firm*—Ked & Associates LLP

(57) ABSTRACT

An apparatus for preventing vacuum of a scroll compressor is provided. The apparatus includes a fixed scroll having a bypass hole, through which a suction chamber of a casing is connected to a discharge chamber of the casing; a valve block having an inner channel, through which the bypass hole of the fixed scroll is connected to the discharge chamber of the casing, and fixedly installed at the fixed scroll; and a valve member disposed between the bypass hole of the fixed scroll and the inner channel of the valve block. Since the apparatus is assembled at an outer periphery of the fixed scroll, a processing error of the fixed scroll is prevented, thereby reducing production costs. Also, since foreign materials generated when a refrigerant channel is processed do not remain in a valve hole, the valve member is prevented from being malfunctioned, productivity is enhanced, and fabrication costs reduced.

15 Claims, 6 Drawing Sheets

[Fig. 1]
CONVENTIONAL ART
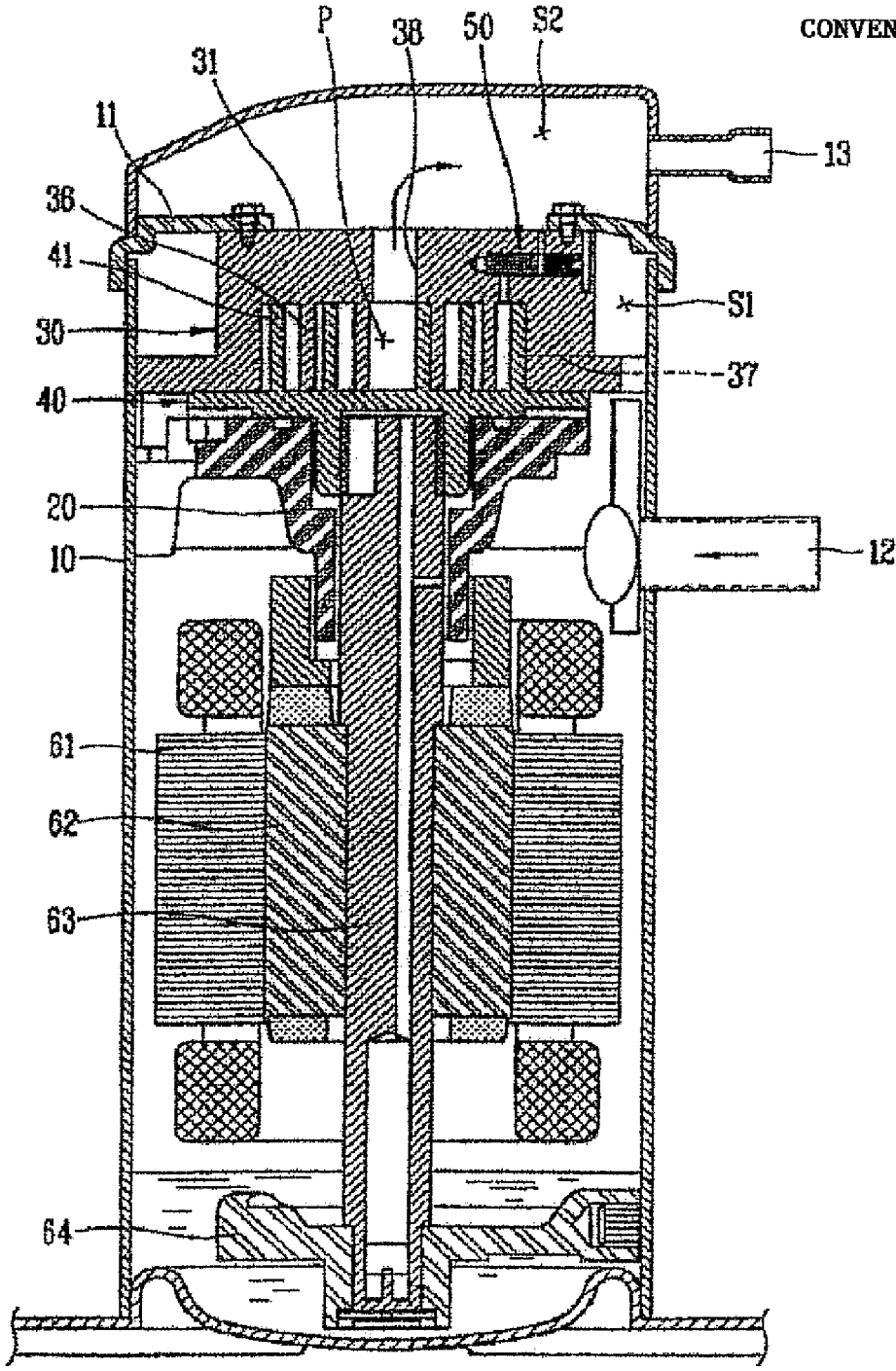

[Fig. 2]
CONVENTIONAL ART
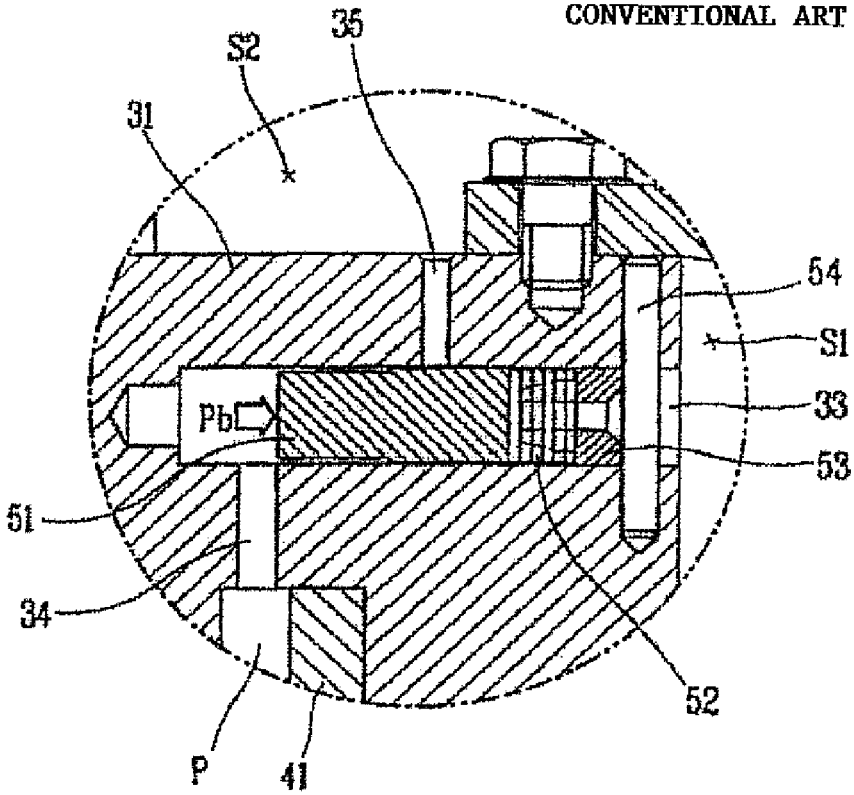
[Fig. 3]
CONVENTIONAL ART
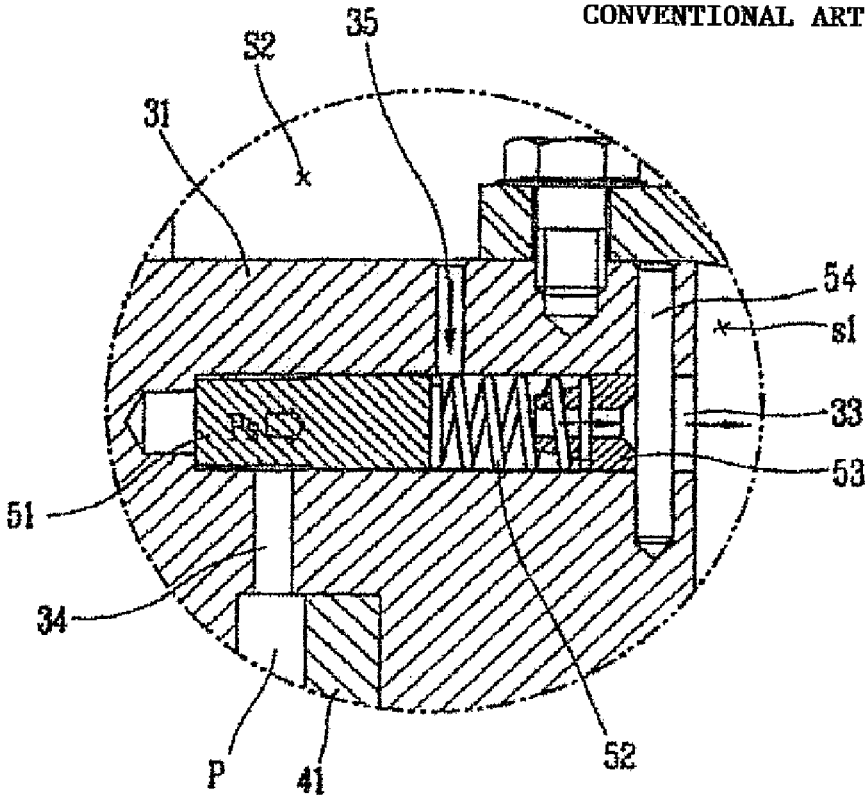

[Fig. 4]
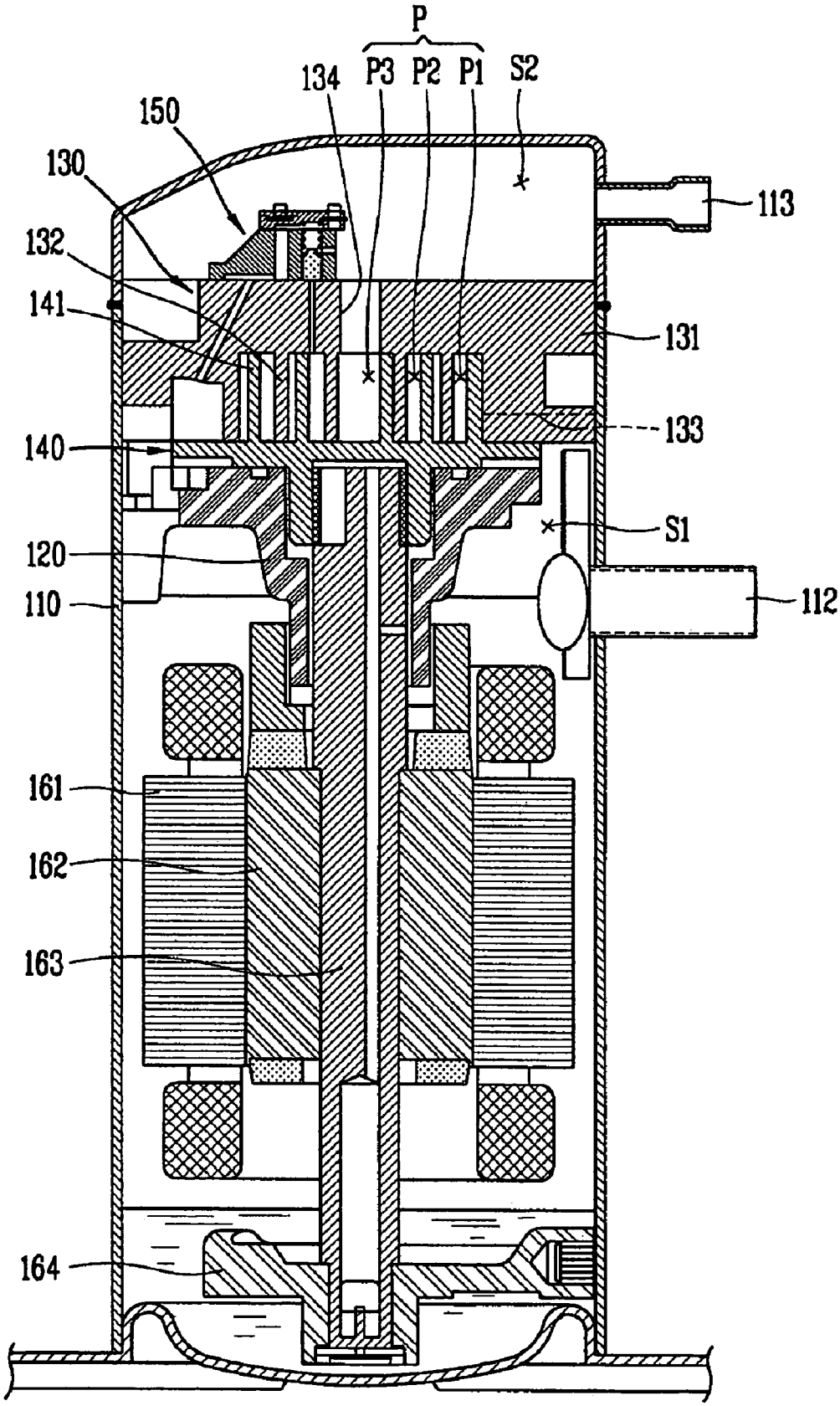

[Fig. 5]
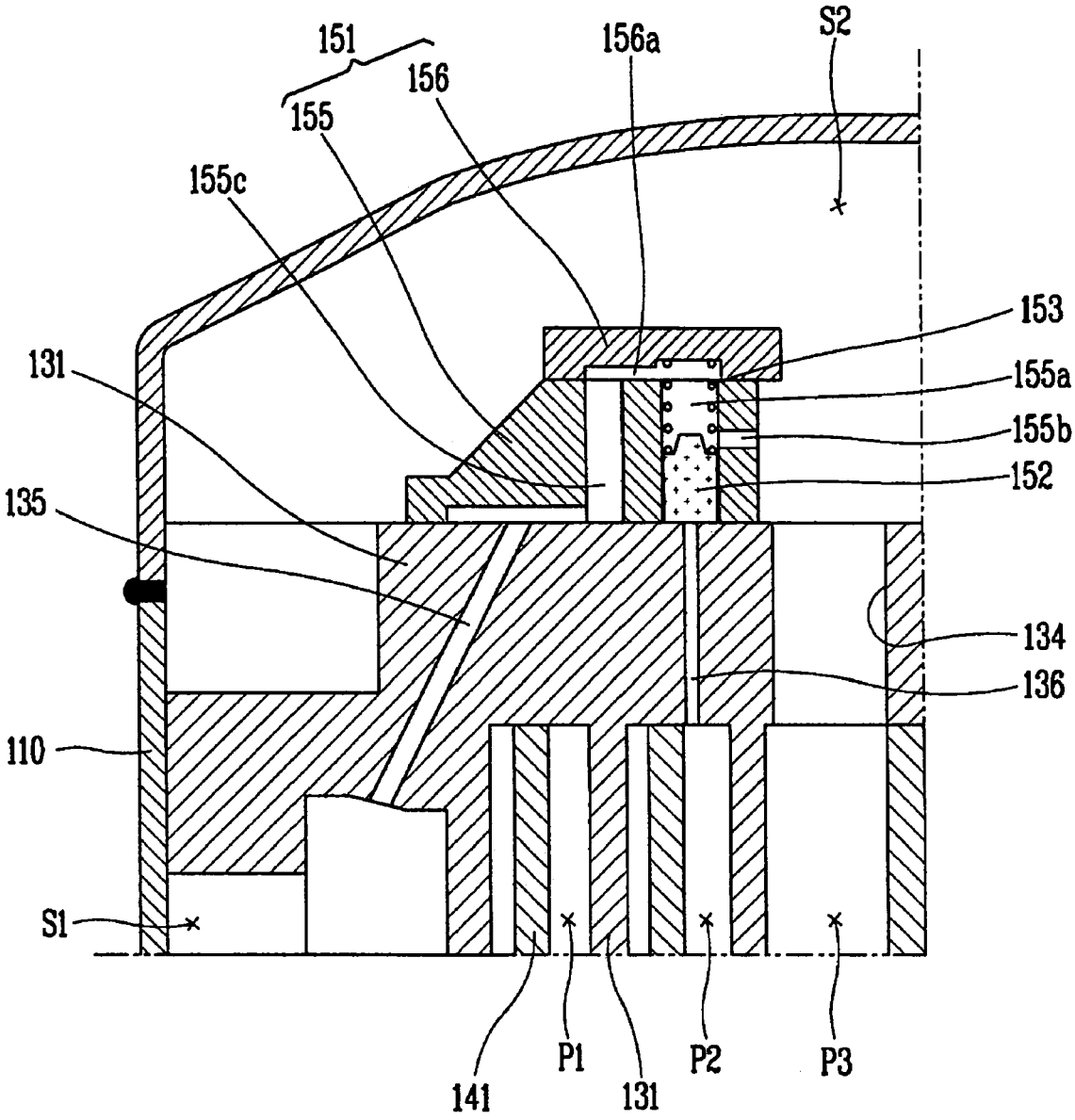

[Fig. 6]
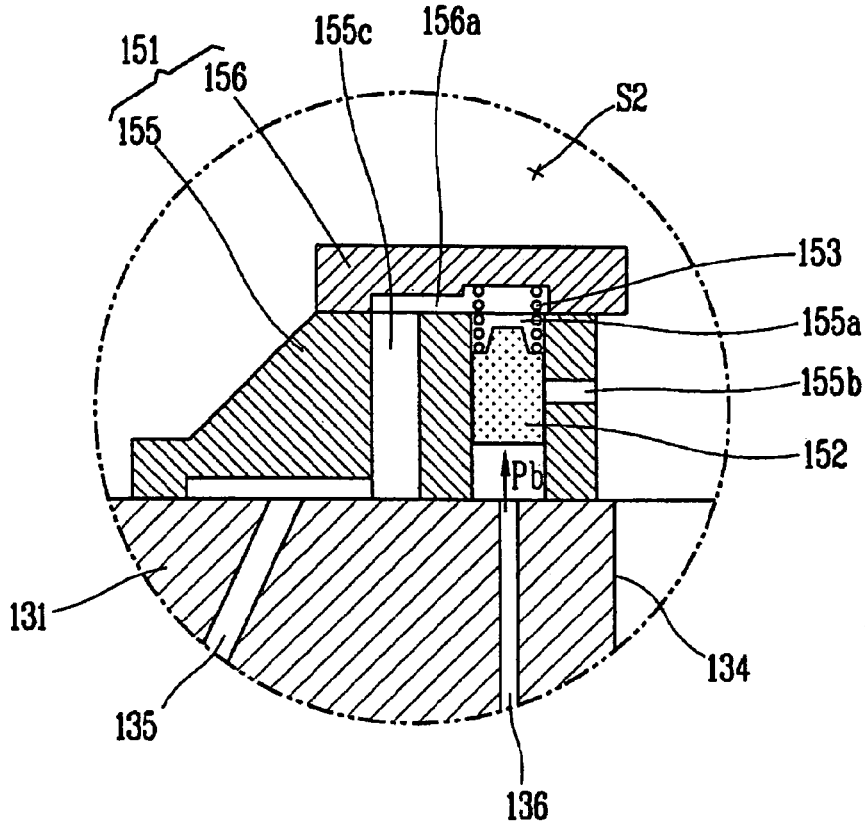
[Fig. 7]
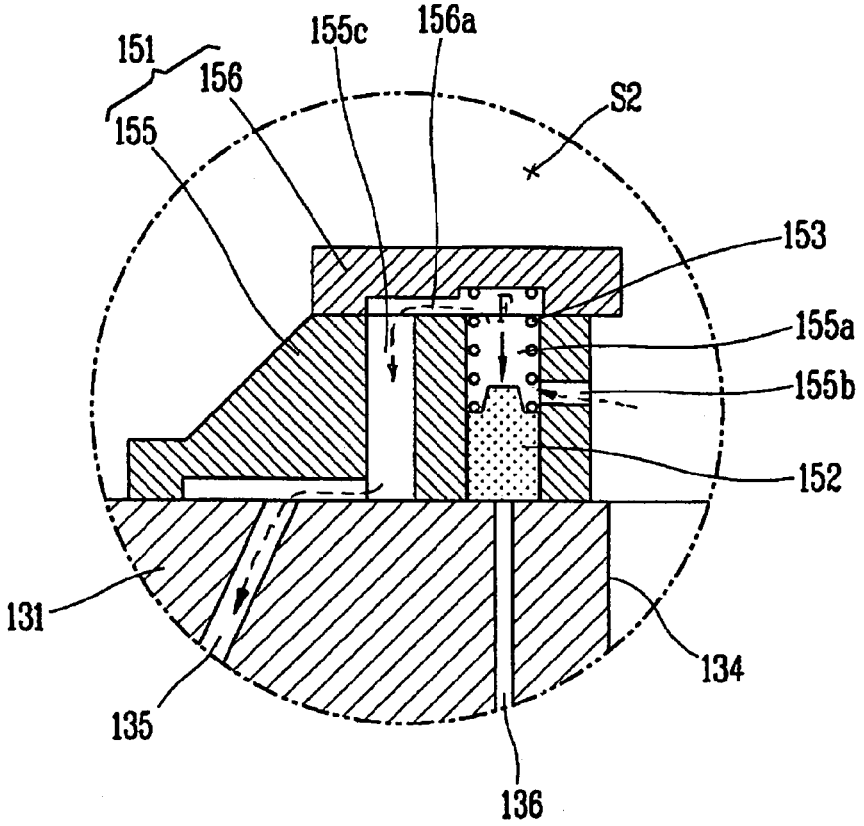

[Fig. 8]
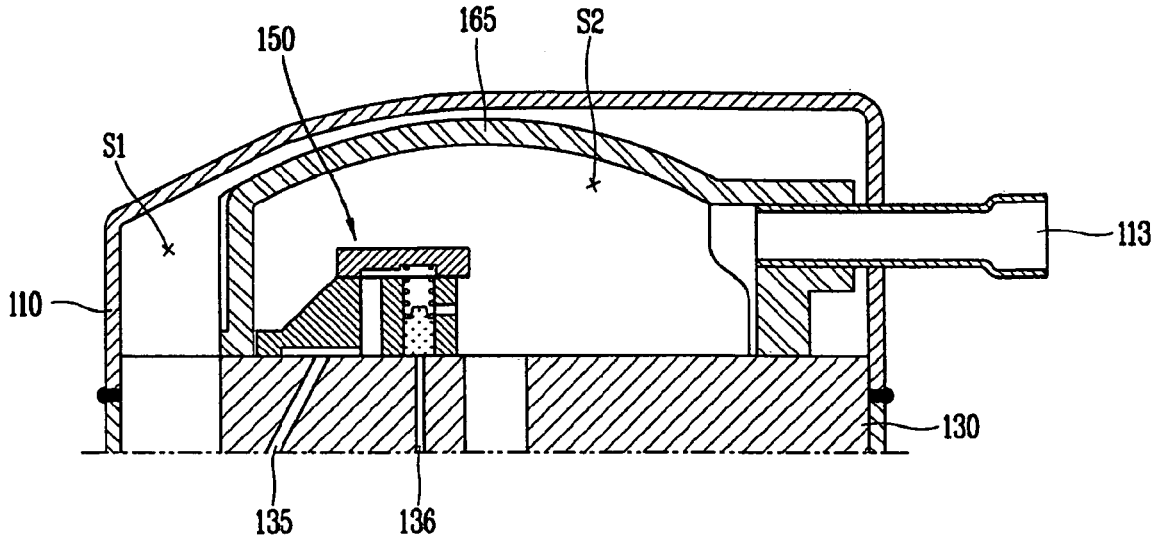
[Fig. 9]
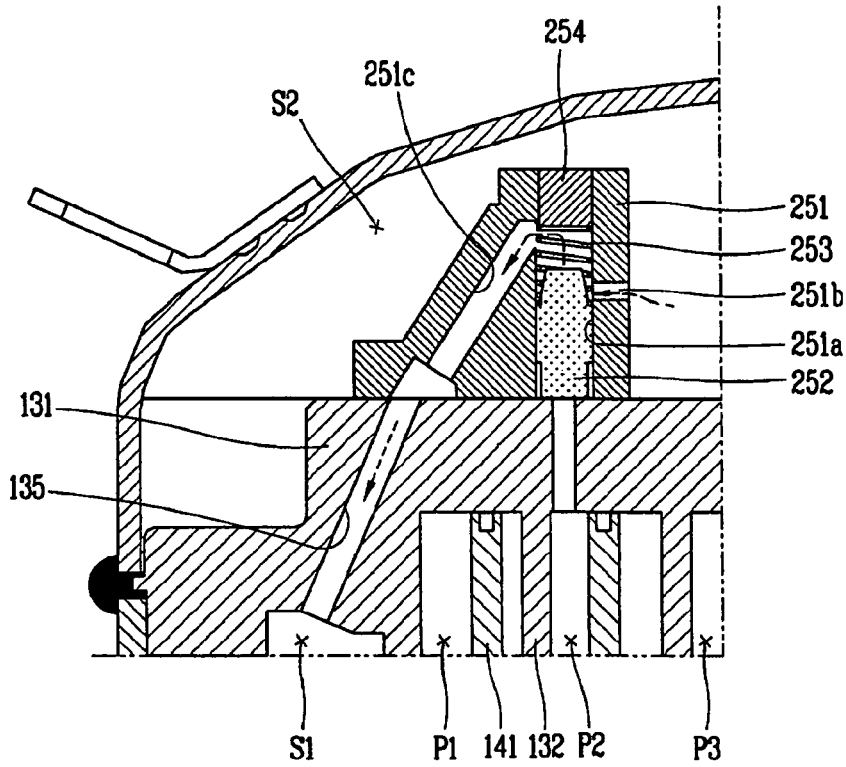

APPARATUS FOR PREVENTING VACUUM OF SCROLL COMPRESSOR

This application is the national phase under 35 U.S.C. §371 of PCT International Application No. PCT/KR2006/001209 which has an International filing date of Mar. 31, 2006, which designated the United States of America.

TECHNICAL FIELD

The present invention relates to a scroll compressor, and more particularly, to an apparatus for preventing vacuum of a scroll compressor capable of preventing a compressor from being driven in a vacuum state by flowing a refrigerant discharged from a high pressure chamber into a compression chamber when the compression chamber becomes a vacuum state during an operation.

BACKGROUND ART

In a scroll compressor, an orbiting scroll that performs an orbit movement by a crank shaft is provided with an orbit wrap of an involute shape thereby to form a compression chamber that consecutively moves with a fixed wrap of an involute shape of a fixed scroll. As the orbiting scroll performs an eccentric orbit movement by a rotation of the crank shaft, a volume of the compression chamber is decreased thereby to compress a refrigerant contained in the compression chamber. When the scroll compressor is operated with a certain compression ratio, the compressed refrigerant is discharged through an outlet.

The scroll compressor can implement a relatively higher compression ratio than any other compressor, and can generate a stable torque by smoothly performing a suction stroke, a compression stroke, and a discharge stroke of a refrigerant. Accordingly, the scroll compressor is being widely used to compress a refrigerant in an air conditioner, etc. When the scroll compressor is normally driven, a suction chamber of a low pressure and a discharge chamber of a high pressure are divided from each other. On the contrary, when the scroll compressor is abnormally driven in a state of a low suction pressure such as a pump down or a cycle clogging, a refrigerant of a high pressure discharged to the discharge chamber is introduced into a compression chamber through the suction chamber under a state that the suction chamber is connected to the discharge chamber, thereby preventing a high vacuum state of the compressor.

FIG. 1 is a sectional view showing an example of a scroll compressor having a vacuum preventing apparatus in accordance with the conventional art, FIG. 2 is a sectional view showing an operation state of the vacuum preventing apparatus when the scroll compressor is normally driven in accordance with the conventional art, and FIG. 3 is a sectional view showing an operation state of the vacuum preventing apparatus when the scroll compressor is driven at a high vacuum state in accordance with the conventional art.

As shown, the conventional scroll compressor comprises a casing 10 divided into a suction chamber S1 of a low pressure and a discharge chamber S2 of a high pressure; a main frame 20 fixedly installed in the casing 10; a fixed scroll 30 fixedly installed at an upper surface of the main frame 20 and having a compression chamber P that consecutively moves with an orbiting scroll 40; and a vacuum preventing unit 50 installed at the fixed scroll 30 for introducing a discharged refrigerant to the compression chamber P by connecting the discharge chamber S2 of a high pressure to the suction chamber S1 of a low pressure when a pressure of the compression chamber P is lowered into a pressure less than a certain pressure.

The casing 10 is divided into the suction chamber S1 of a low pressure and the discharge chamber S2 of a high pressure by a high-low pressure separation plate 11 of which an inner circumferential surface is adhered to an upper surface of a plate 31 of the fixed scroll 30 and an outer circumferential surface thereof is adhered to an inner circumferential surface of the casing 10. A suction pipe 12 is connected to the suction chamber S1, and a discharge pipe 13 is connected to the discharge chamber S2.

A bypass channel for opening and closing the suction chamber S1 and the discharge chamber S2 of the casing 10 by a sliding valve 51 of the vacuum preventing unit 50 is formed at the plate 31 of the fixed scroll 30. The bypass channel comprises a valve hole 32 concaved with a certain depth at the plate 31 of the fixed scroll 30 in a horizontal direcrion-4, a suction pressure channel 33 through which the valve hole 32 is connected to the suction chamber S2 of the casing 10, a middle pressure channel 34 through which the valve hole 32 is connected to the compression chamber, and a discharge pressure channel 35 through which the valve hole 32 is connected to the discharge chamber S2 of the casing 10.

The vacuum preventing unit 50 comprises a sliding valve 51 for closing the discharge pressure channel 35 by being slidably inserted into the valve hole 32 in a horizontal direction when the compression chamber P maintains a certain pressure, and for introducing a refrigerant inside the discharge chamber S2 into the suction chamber S1 by connecting the discharge pressure channel 35 to the suction pressure channel 33 when a pressure of the compression chamber P is lowered into a pressure less than the certain pressure; and a valve spring 52 provided at one side of the sliding valve 51 for elastically supporting the sliding valve 51.

Unexplained reference numeral 36 denotes a fixed wrap, 37 denotes an inlet, 38 denotes an outlet, 41 denotes an orbit wrap, 53 denotes a valve cover, 54 denotes a fixing pin, 61 denotes a stator, 62 denotes a rotor, 63 denotes a crank shaft, and 64 denotes a sub frame.

In the conventional vacuum preventing apparatus of a scroll compressor, when a new refrigerant is supplied to the compression chamber P, the vacuum preventing unit 50 closes between the discharge pressure channel 35 of the fixed scroll 30 and the suction pressure channel 33 and thus a refrigerant is normally compressed. On the contrary, when a little amount of refrigerant is sucked into the compression chamber P, the vacuum preventing unit 50 connects the discharge pressure channel 35 to the suction pressure channel 33 so that a refrigerant discharged to the discharge chamber S2 can be supplied to the compression chamber P via the suction chamber S1.

As shown in FIG. 2, when the compression chamber P maintains a certain pressure, the pressure of the compression chamber P becomes equivalent to a resultant force between an elastic force of the valve spring 52 and a pressure of the suction chamber S1, and thus the sliding valve 51 closes the discharge pressure channel 35. On the contrary, as shown in FIG. 3, when the pressure of the compression chamber P is lowered into a pressure less than the certain pressure, the pressure of the compression chamber P becomes smaller than the resultant force between an elastic force OT the valve spring 52 and a pressure of the suction chamber S1. As the result, the sliding valve 51 is moved towards an opposite side to the valve spring 52, and thus the discharge pressure channel 35 is connected to the suction pressure channel 33.

However, the conventional vacuum preventing apparatus of a scroll compressor has the following problems.

First, the valve hole 32 is concaved by a certain depth at an outer circumferential surface of the plate 31 of the fixed scroll 30 towards a center of the plate 31, and the middle pressure channel 34 or the discharge pressure channel 35 is connected to the valve hole 32. As the result, burr generated when the middle pressure channel 34 and the discharge pressure channel 35 are mechanically processed remains in the valve hole 32 thereby to serve as an obstacle when the sliding valve 51 is operated.

Second, oil and refrigerant inside the compression chamber P are introduced into the valve hole 32 through the middle pressure channel 34 connected to the valve hole 32, and then remain in the valve hole 32 thereby to serve as an obstacle when the sliding valve 51 is operated.

Third, since the valve hole 32 is formed at a lateral wall of the fixed scroll 30 in a horizontal direction, a processing of the valve hole 32 is difficult, a defective proportion in processing the fixed scroll 30 is increased, and thus a production cost for the fixed scroll 30 is increased. Furthermore, since a gap between the valve hole 32 and the sliding valve 51 is increased due to an inaccurate dimension of the valve hole 32, a refrigerant inside the discharge chamber S2 is leaked thereby to degrade an efficiency of the compressor.

DISCLOSURE OF THE INVENTION

Therefore, an object of the present invention is to provide an apparatus for preventing vacuum of a scroll compressor capable of smoothly operating a sliding valve and enhancing a reliability and an efficiency of the compressor by preventing burr or foreign materials generated when a bypass channel is mechanically processed from remaining at a refrigerant channel and by preventing oil introduced into the bypass channel from excessively remaining at the bypass channel.

Another object of the present invention is to provide an apparatus for preventing vacuum of a scroll compressor capable of simplifying a fabrication process and reducing a production cost by reducing a defective proportion.

To achieve these and other advantages and in accordance with the purpose of the present invention, as embodied and broadly described herein, there is provided an apparatus for preventing vacuum of a scroll compressor, comprising: a casing having a hermetic space divided into a suction chamber of a low pressure and a discharge chamber of a high pressure; a fixed scroll fixedly installed between the suction chamber of the casing and the discharge chamber, having a compression chamber that consecutively moves by being engaged with an orbiting scroll, having an outlet through which a refrigerant compressed in the compression chamber is discharged to the discharge chamber, and having a bypass hole through which the suction chamber of the casing is connected to the discharge chamber; a valve block having an inner channel through which the bypass hole of the fixed scroll is connected to the discharge chamber of the casing and fixedly installed at the fixed scroll; and a valve member disposed between the bypass hole of the fixed scroll and the inner channel of the valve block, for opening between the bypass hole and the inner channel thereby supplying a refrigerant of the discharge chamber to the suction chamber when a pressure of the compression chamber is lowered into a pressure less than a certain pressure, and for closing between the bypass hole and the inner channel thereby preventing the refrigerant of the discharge chamber from backflowing into the suction chamber when the compression chamber maintains a certain pressure.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 1 is a sectional view showing an example of a scroll compressor having a vacuum preventing apparatus in accordance with the conventional art;

FIG. 2 is a sectional view showing an operation state of the vacuum preventing apparatus when the scroll compressor is normally driven in accordance with the conventional art;

FIG. 3 is a sectional view showing an operation state of the vacuum preventing apparatus when the scroll compressor is driven at a high vacuum state in accordance with the conventional art;

FIG. 4 is a sectional view showing a scroll compressor having an apparatus for preventing vacuum of a scroll compressor according to a first embodiment of the present invention;

FIG. 5 is a sectional view showing the apparatus for preventing vacuum of a scroll compressor according to the present invention by enlargement;

FIG. 6 is a sectional view showing an operation state of a vacuum preventing unit when the scroll compressor is normally driven according to the present invention;

FIG. 7 is a sectional view showing an operation state of the vacuum preventing unit when the scroll compressor is driven at a high vacuum state according to the present invention;

FIG. 8 is a sectional view showing the scroll compressor according to a second embodiment of the present invention; and FIG. 9 is a sectional view showing an apparatus for preventing vacuum of a scroll compressor according to a second embodiment of the present invention.

MODES FOR CARRYING OUT THE PREFERRED EMBODIMENTS

Reference will now be made in detail to the preferred embodiments of the present invention, examples of which are illustrated in the accompanying drawings.

Hereinafter, an apparatus for preventing vacuum of a scroll compressor according to the present invention will be explained in more detail with reference to the attached drawings.

FIG. 4 is a sectional view showing a scroll compressor having an apparatus for preventing vacuum of a scroll compressor according to a first embodiment of the present invention, FIG. 5 is a sectional view showing the apparatus for preventing vacuum of a scroll compressor according to the present invention by enlargement, FIG. 6 is a sectional view showing an operation state of a vacuum preventing unit when the scroll compressor is normally driven according to the present invention, and FIG. 7 is a sectional view showing an operation state of the vacuum preventing unit when the scroll compressor is driven at a high vacuum state according to the present invention.

As shown in FIG. 4, the scroll compressor according to the present invention comprises a casing 110 divided into a suction chamber S1 of a low pressure and a discharge chamber S2 of a high pressure; a main frame 120 fixedly installed in the casing 110; a fixed scroll 130 fixedly installed at an upper surface of the main frame 120 and having a compression chamber P that consecutively moves by being engaged with an orbiting scroll 140; and a vacuum preventing unit 150 installed at an upper surface of the fixed scroll 130 inside the discharge space S2 of the casing 110, for introducing a discharged refrigerant to the compression chamber P by connecting the discharge chamber S2 of a high pressure to the suction chamber S1 of a low pressure when a pressure of the compression chamber P is lowered into a pressure less than a certain pressure.

As shown in FIG. 4, an outer circumferential surface of a plate 131 of the fixed scroll 130 is adhered to an inner circumferential surface of the casing 110, and thus the suction chamber S1 of a low pressure and the discharge chamber S2 of a high pressure are divided from each other. A suction pipe 112 is connected to the suction chamber S1, and a discharge pipe 113 is connected to the discharge chamber S2.

As shown in FIG. 8 the casing 110 is divided into the suction chamber S1 of a low pressure and the discharge chamber S2 of a high pressure by a discharge planum 165 fixed to an upper surface of the plate 131 of the faxed scroll 130. Although not shown, the inner space of the casing 110 can be divided into the suction chamber and the discharge chamber by a high-low pressure separation plate faxed to an upper surface of the fixed scroll and adhered to an inner circumferential surface of the casing.

A construction of the fixed scroll 130 will be explained with reference to FIGS. 4 and 5. A fixed wrap 132 of an involute shape is protruding from a lower surface of the plate 131 thus to form the compression chamber P with an orbit wrap 141 of the orbiting scroll 140. An inlet 133 through which the suction chamber S1 of the casing 110 is connected to the outermost compression chamber P1 is formed at a bottom surface of an outer circumferential surface of the plate 131. An outlet 134 through which the last compression chamber P3 is connected to the discharge chamber S2 of the casing 110 is formed in the middle of the plate 131. A bypass hole 135 is formed at an outer circumferential surface of the plate 131 with a certain inclination angle so that the suction chamber S1 of the casing 110 and the discharge chamber S2 can be opened and closed by a valve member 152 of the vacuum preventing unit 150. A middle pressure channel 136 through which a middle compression chamber P2 is connected to a valve hole 155*a* of a valve body 155 that will be later explained is formed in the middle of the plate 131.

As shown in FIG. 5, the vacuum preventing unit 150 comprises a valve block 151 having an inner channel through which the bypass hole 135 of the fixed scroll 130 is connected to the discharge chamber S2 of the casing 110 and fixedly installed at an opposite side to the inlet of the fixed scroll 130, a valve member 152 installed between the bypass hole 135 of the fixed scroll 130 and the inner channel of the valve block 151 for opening and closing between the bypass hole 135 and the inner channel in correspondence with a pressure variation of the compression chamber P, and an elastic member 153 supported at an upper surface of the valve member 152 for pressurizing the valve member 152 so as to be slidable in upper and lower directions according to a pressure difference.

As shown in FIG. 5, the valve block 151 comprises a valve body 155 having a valve hole 155*a* through which the valve member 152 is slidably inserted in upper and lower directions, and fixed to an upper surface of the plate 131 of the fixed scroll 130; and a block cover 156 fixed to an upper surface of the valve body 155 thereby to form an inner channel with the valve body 155. The valve hole 155*a* is coaxially formed with the middle pressure channel 136 or is provided with the middle pressure channel 136 SO that oil introduced into the valve hole 155*a* can be fast discharged to the compression chamber P.

As shown in FIG. 5, the valve hole 155*a* is penetratingly formed at the block body 155 in upper and lower directions, and a discharge pressure channel 155*b* is penetratingly formed in the middle of the valve hole 155*a* towards the discharge chamber S2 of the casing 110. A first connection channel 155*c* connected between the valve hole 155*a* and the bypass hole 135 by a second connection channel 156*a* of a block cover 156 that will be later explained is penetratingly formed at an outer side of the valve hole 155*a* in upper and lower directions. The first connection channel 155*c* can be extendingly formed from an end of the bypass hole 135 so as to be concaved in right and left directions.

As shown in FIG. 5, a second connection channel 156*a* that constitutes a connection channel with the first connection channel 155*c* is concaved at a lower surface of the block cover 156, through which the valve hole 155*a* of the valve body 155 and the first connection channel 155*c* are connected to each other.

The same reference numerals were given to the same parts as those of the conventional art.

Unexplained reference numeral 161 denotes a stator, 162 denotes a rotor, 163 denotes a crank shaft, and 164 denotes a sub-frame.

An operation of the apparatus for preventing vacuum of a scroll compressor according to the present invention will be explained.

When power is supplied to the stator 161, the rotor 162 is rotated by an electro-magnetic force of the stator 161 thereby to rotate the crank shaft 163. As the orbiting scroll 140 electrically coupled to the end of the crank shaft 163 performs an orbit movement, a pair of compression chambers P that consecutively move are formed between the fixed scroll 130 and the orbiting scroll 140. Herein, a refrigerant provided from outside of the casing 110 is introduced into the suction chamber S1 of a low pressure of the casing 110 through the suction pipe 112. The refrigerant of a low pressure of the suction space S1 is introduced into the outermost compression chamber P1 through the inlet 133 of the fixed scroll 130, and then is moved to the last compression chamber P3 by the orbiting scroll 140. The refrigerant is compressed, and then is discharged to the discharge chamber S2 of the casing 110 through the outlet 133 of the fixed scroll 130, which is repeatedly performed.

As shown in FIG. 6, when a new refrigerant is supplied to the compression chamber, the valve member 152 of the vacuum preventing unit 150 is upwardly moved towards the elastic member 153 by a pressure Pb applied through the middle pressure channel 136. As the result, the valve member 152 closes the discharge pressure channel 155*b* and thus the refrigerant discharged to the discharge chamber S2 is prevented from backflowing to the suction chamber S1, thereby normally compressing the refrigerant. On the contrary, as shown in FIG. 7, when a little amount of refrigerant is sucked into the compression chamber P, the pressure of the compression chamber P becomes similar to a vacuum pressure. As the result, the pressure of the compression chamber P applied through the middle pressure channel 136 becomes smaller than an elastic force F of the elastic member 153. Accordingly, the valve member 152 is downwardly moved towards the fixed scroll 130 by the elastic member 153, and thus the discharge pressure channel 155*b* is opened. A part of the refrigerant discharged to the discharge chamber S2 is introduced into the suction chamber S1 of a low pressure via the valve hole 155*a*, the second connection channel 156*a*, the first connection channel 155*c*, and the bypass hole 135, and then is supplied to the outermost compression chamber P1 through the inlet 133 of the fixed scroll 130, thereby preventing the compression chamber P from being in a high vacuum state.

The apparatus for preventing vacuum of a scroll compressor according to the present invention is assembled at an outer periphery of the fixed scroll 130. As the result, even if the vacuum preventing unit 150 is processed with an inferiority, the fixed scroll 130 having a high price and a difficult processing does not need to be re-fabricated, thereby enhancing a productivity and reducing a fabrication cost.

Also, the inner channel of the vacuum preventing unit 150 through which the discharge chamber S2 of a high pressure is connected to the suction chamber S1 of a low pressure is perpendicularly penetratingly-formed at the block body 155 like the valve hole 155*a* and the first connection channel 155*c*, or is concaved at a lower surface of the block cover 156 like the second connection channel 156*a*. As the result, the block body 155 or the block cover 156 is easily processed, and burr generated at the time of processing the hole is removed thereby to allow a stable motion of the valve member 152 and enhancing a reliability of the scroll compressor. For instance, the discharge pressure channel 155*b* is horizontally drill-processed at the block body 155 by a certain depth, and the valve hole 155*a* is penetratingly processed in a perpendicular direction to the discharge pressure channel 155*b*. As the result, even if burr is generated at an inner end of the discharge pressure channel 155*b*, the burr is removed at the time of processing the valve hole 155*a*. Furthermore, since the first connection channel 155*c* is penetratingly formed at the block body 155 separately from the valve hole 155*a*, burr generated at the time of processing the first connection channel 155*c* does not influence on the valve hole 155*a*.

Another embodiment of the apparatus for preventing vacuum of a scroll compressor according to the present invention will be explained.

In the aforementioned embodiment, the block body 155 and the block cover 156 are separately fabricated, and then are assembled to each other thereby to constitute the valve block 151. However, in another embodiment of the present invention, the valve block 251 is fabricated to be coupled to the fixed scroll.

For instance, as shown in FIG. 9 a valve hole 251*a* connected to the middle pressure channel 136 of the fixed scroll 130 is penetratingly formed at the valve block 251 in upper and lower directions, and a discharge pressure channel 251*b* is penetratingly formed in the middle of the valve hole 251*a* towards the discharge chamber S2. A connection channel 251*c* connected to the bypass hole 135 of the fixed scroll 130 is inclined at an upper end of the valve hole 251*a*, and is penetratingly formed towards a lower end of the valve hole 251*a*. A valve cover 254 for supporting an elastic member 253 that elastically supports a valve member 252 is inserted into the upper end of the valve hole 251*a*.

The apparatus for preventing vacuum of a scroll compressor according to another embodiment of the present invention has the same operation and effect as that according to one embodiment of the present invention, and thus its minute explanation will be omitted.

Effects of the present invention will be explained as follows.

Since the apparatus for preventing vacuum of a scroll compressor according to the present invention is assembled at an outer periphery of the fixed scroll, a processing error of the fixed scroll is prevented thereby to enhance a productivity and to reduce a production cost. Also, since foreign materials such as burr generated when the refrigerant channel through which a high pressure portion and a low pressure portion are connected to each other is processed does not remain in the valve hole, the valve member for opening and closing the refrigerant channel is prevented from being mal-operated. Furthermore, since the refrigerant channel is easily processed, a productivity is enhanced and a fabrication cost is reduced.

In the apparatus for preventing vacuum of a scroll compressor according to the present invention, a processing error of the fixed scroll is prevented thereby to enhance a productivity and to reduce a production cost. Furthermore, since foreign materials are prevented from remaining at the refrigerant channel, the valve member for opening and closing the refrigerant channel is prevented from being mal-operated.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

The invention claimed is:

1. An apparatus for preventing vacuum of a scroll compressor, the apparatus comprising:

a casing having a hermetic inner space divided into a suction chamber of a low pressure and a discharge chamber of a high pressure;

a fixed scroll fixedly installed between the suction chamber and the discharge chamber, that forms a compression chamber that consecutively moves by being engaged with an orbiting scroll, wherein the fixed scroll includes an outlet through which a refrigerant compressed in the compression chamber is discharged to the discharge chamber, a middle pressure channel through which the refrigerant compressed in a middle pressure chamber is discharged to the discharge chamber, and a bypass hole through which the suction chamber is connected to the discharge chamber;

a valve block having an inner channel through which the bypass hole of the fixed scroll is connected to the discharge chamber of the casing, wherein the valve block is fixedly installed at the fixed scroll; and a valve member disposed between the bypass hole of the fixed scroll and the inner channel of the valve block, wherein the valve member is configured to provide fluid communication between the bypass hole and the inner channel when a pressure of the compression chamber is lowered to a pressure less than a predetermined pressure and to prevent the fluid communication between the bypass hole and the inner channel when the compression chamber maintains the predetermined pressure, wherein the valve block comprises:

a block body having a valve hole configured to slidably receive the valve member, a discharge pressure channel that connects the valve hole to the discharge chamber, and a first connection channel penetratingly formed from the valve hole to the bypass hole of the fixed scroll; and a block cover having a second connection channel trough which the valve hole of the block body is connected to the first connection channel, and fixed to the block body.

2. The apparatus of claim 1, wherein the second connection channel is concave at a contact surface to the block body to a predetermined depth.

3. The apparatus of claim 1, further comprising a valve spring provided at an opposite side to the middle pressure channel so as to be against a pressure of the middle pressure chamber that is applied to the valve member through the middle pressure channel.

4. The apparatus of claim 3, wherein the valve hole is formed in line with the middle pressure channel.

5. The apparatus of claim 1, wherein the casing is divided into the suction chamber and the discharge chamber by a high-low pressure separation plate, an inner circumferential surface of which is adhered to the fixed scroll and an outer circumferential surface of which is adhered to an inner circumferential surface of the casing.

6. The apparatus of claim 1, wherein the casing is divided into the suction chamber and the discharge chamber by a discharge planum that constitutes the discharge chamber by receiving an outlet of the fixed scroll.

7. The apparatus of claim 1, wherein the valve block is fixed to an upper surface of the fixed scroll, which is disposed in the discharge chamber of the casing.

8. The apparatus of claim 1, wherein the fixed scroll is provided with an inlet connected to the compression chamber at one side thereof; and the bypass hole is formed at an opposite side to the inlet.

9. An apparatus for preventing vacuum of a scroll compressor, the apparatus comprising:

a case having a hermetic inner space divided into a suction chamber of a low pressure and a discharge chamber of a high pressure;

a fixed scroll fixedly installed between the suction chamber and the discharge chamber, that forms a compression chamber that consecutively moves by being engaged with an orbiting scroll, wherein the fixed scroll includes an outlet through which a refrigerant compressed in the compression chamber is discharged to the discharge chamber, a middle pressure channel through which the refrigerant to being compressed in a middle pressure chamber is discharged to the discharge chamber, and a bypass hole through which the suction chamber is connected to the discharge chamber;

a valve block having an inner channel through which the bypass hole of the fixed scroll is connected to the discharge chamber of the casing, and fixedly installed at the fixed scroll; and a valve member disposed between the bypass hole of the fixed scroll and the inner channel of the valve block, wherein the valve member is configured to provide fluid communication between the bypass hole and the inner channel when a pressure of the compression chamber is lowered to a pressure less than a predetermined pressure, and prevent the fluid communication between the bypass hole and the inner channel when the compression chamber maintains the predetermined pressure, wherein the valve block comprises:

a block body having a valve hole configured to slidably receive the valve member and penetratingly formed up to an upper end of the valve body, a discharge pressure channel that connects the valve hole to the discharge chamber, and a first connection channel penetratingly formed from the valve hole to the bypass hole of the fixed scroll; and a valve cap coupled to an end of the valve hole.

10. The apparatus of claim 9, further comprising a valve spring provided at an opposite side to the middle pressure channel so as to be against a pressure of the middle pressure chamber that is applied to the valve member through the middle pressure channel.

11. The apparatus of claim 10, wherein the valve hole is formed in line with the middle pressure channel.

12. The apparatus of claim 9, wherein the casing is divided into the suction chamber and the discharge chamber by a high-low pressure separation plate, an inner circumferential surface of which is adhered to the fixed scroll and an outer circumferential surface of which is adhered to an inner circumferential surface of the casing.

13. The apparatus of claim 9, wherein the casing is divided into the suction chamber and the discharge chamber by a discharge plenum that constitutes the discharge chamber by receiving an outlet of the fixed scroll.

14. The apparatus of claim 9, wherein the valve block is fixed to an upper surface of die fixed scroll, which is disposed in the discharge chamber of the casing.

15. The apparatus of claim 9, wherein the fixed scroll is provided with an inlet connected to the compression chamber at one side thereof and the bypass hole is formed at an opposite side to the inlet.

* * * * *